US008297805B2

(12) United States Patent
Roucoules et al.

(10) Patent No.: US 8,297,805 B2
(45) Date of Patent: Oct. 30, 2012

(54) DEVICE FOR COOLING AN OPTICAL MODULE FOR A MOTOR VEHICLE HEADLIGHT

(75) Inventors: Christine Roucoules, Deuil la Barre (FR); Eric Mornet, Vincennes (FR)

(73) Assignee: Valeo Vision, Bobigny (FR)

( * ) Notice: Subject to any disclaimer, the term of this patent is extended or adjusted under 35 U.S.C. 154(b) by 322 days.

(21) Appl. No.: 12/640,245

(22) Filed: Dec. 17, 2009

(65) Prior Publication Data

US 2010/0157606 A1 Jun. 24, 2010

(30) Foreign Application Priority Data

Dec. 18, 2008 (FR) ..... 08 07166

(51) Int. Cl.
*F21V 29/00* (2006.01)

(52) U.S. Cl. ..... 362/373; 362/547

(58) Field of Classification Search ..... 362/294, 362/373, 547

See application file for complete search history.

(56) References Cited

U.S. PATENT DOCUMENTS

| | | | | |
|---|---|---|---|---|
| 7,114,837 | B2 | 10/2006 | Yagi et al. | |
| 7,249,868 | B2 | 7/2007 | Chinniah et al. | |
| 7,275,848 | B2 | 10/2007 | Chinniah et al. | |
| 7,329,033 | B2 * | 2/2008 | Glovatsky et al. | 362/547 |
| 7,427,152 | B2 * | 9/2008 | Erion et al. | 362/547 |
| 7,625,110 | B2 * | 12/2009 | Kracker et al. | 362/547 |
| 2004/0202007 | A1 | 10/2004 | Yagi et al. | |
| 2006/0181894 | A1 | 8/2006 | Chinniah et al. | |
| 2007/0008727 | A1 | 1/2007 | Chinniah et al. | |
| 2007/0035957 | A1 | 2/2007 | Albou et al. | |
| 2008/0025038 | A1 | 1/2008 | Chiang | |
| 2008/0285298 | A1 * | 11/2008 | Shuy | 362/547 |
| 2009/0014154 | A1 | 1/2009 | Schick et al. | |

FOREIGN PATENT DOCUMENTS

| | | | |
|---|---|---|---|
| DE | 102006001711 | A1 | 7/2007 |
| EP | 1726874 | | 11/2006 |
| EP | 1881262 | A1 | 1/2008 |
| FR | 2853717 | A1 | 10/2004 |
| WO | 2005116520 | A1 | 12/2005 |
| WO | 2007053939 | A1 | 5/2007 |

* cited by examiner

*Primary Examiner* — Alan Cariaso

(74) *Attorney, Agent, or Firm* — Jacox, Meckstroth & Jenkins

(57) ABSTRACT

A lighting and/or signaling device comprising at least one optical module equipped with a cooling unit, comprising at least one heat conductor, one end of which is placed spaced from the cooling unit, and is provided with a plurality of deflectors which channel a flow of cold air towards a heat-exchange surface of the cooling unit.

20 Claims, 3 Drawing Sheets

DEVICE FOR COOLING AN OPTICAL MODULE FOR A MOTOR VEHICLE HEADLIGHT

CROSS-REFERENCE TO RELATED APPLICATIONS

This application claims priority to French Application No. 0807166 filed Dec. 18, 2008, which application is incorporated herein by reference and made a part hereof.

BACKGROUND OF THE INVENTION

1. Field of the Invention

The invention relates to the field of lighting devices, and more particular to that of motor vehicle headlights. Its object is a device for cooling one or a plurality of optical modules which equip a headlight of this type, for emission of various light beams. More specifically, this cooling device is of the type which induces heat exchange by convection between this flow of air and the heat-exchange surface of a cooling unit, such as a heat dissipater with fins or the like, which equips the optical module(s).

2. Description of the Related Art

In general, motor vehicle headlights consist of a housing which is closed by a transparent wall, through which one or a plurality of light beams are emitted. This housing accommodates at least one optical module, comprising mainly a source of light and an optical system which can modify at least one parameter of the light which is generated by the source of light, for emission of the light beam by the optical module. The optical system comprises optical components such as a reflector, a lens, a diffusing element or a collimator, or any other unit which can modify at least one of the parameters of the light generated by the source of light, such as its mean reflection and/or its direction.

The development of the technology is tending to favor the use of sources of light constituted by at least one LED (Light Emitting Diode), because of the low energy consumption of these lights and the quality of the lighting obtained. LEDs do not radiate in an omni-directional manner, but in a more directive manner than other sources of light. The small size of LEDs and their directive radiation of light make it possible to reduce the dimensions and simplify the structure of the optical module, with the advantage of facilitating integration of the latter in the interior of the housing. However, during functioning, the LEDs produce heat which is detrimental to their operation, since the more the temperature of an LED increases, the more its flow of light decreases. It is therefore necessary to make provisions for discharging the heat generated by the LED(s) which constitute the source of light of the optical module, in order to avoid an increase in temperature of the LEDs above a tolerable operating threshold.

For this purpose, the optical module is commonly equipped with a cooling unit in the form of a heat dissipater with fins, such as a radiator with fins or a similar heat-exchange unit. The cooling unit constitutes a support for the LED(s) installed on an electronic control board which is dedicated to each of the LEDs, or is common to all of them, or even to the optical system(s) at least partly, or commonly often in its/their entirety. The cooling unit makes it possible to discharge the heat which is generated by the source of light towards the interior volume of the housing and/or towards the exterior of the housing, on the basis of heat exchange which uses the surface of the fins which the cooling unit comprises. Optimization of the heat exchange between the dissipater with fins heated by the LEDs and the air can be obtained by increasing the surface area, by means of an increase in the size and/or number of fins of the cooling unit. However, this solution has the disadvantage of resulting in a consequent increase in the weight and overall dimensions of the optical module, which should be avoided in order to facilitate installation of the module inside the housing. Installation of this type may be made problematic because of shortage of space available for receipt of the optical module(s), and/or because of the constraints associated with the overall arrangement of the headlight in relation to its close environment when it is fitted on the vehicle. It is consequently advantageous to organize the cooling of the optical module(s) so as to avoid impeding its/their ease of installation inside the housing.

Account must also be taken of the fact that the volume of the means used for cooling of the LEDs which the optical modules comprise depends on the quantity of heat which they generate, according to the operating power, which itself is dependent on the intensity of light necessary for emission by the headlight of the corresponding light beam.

More particularly, an optical module or group of optical modules is organized in order to constitute a lighting device and/or signaling device which requires strong intensity of light, such as for a dipped beam, a full beam, a fog beam or a daytime signaling light. The number of LEDs and/or the power which is necessary in order for them to function is high, and the cooling means which are used for optical modules of this type are designed to make it possible to discharge a substantial amount of heat generated by the LEDs. If only the air which is naturally present in the interior of the housing is used to obtain adequate cooling of the LEDs, the lighting and/or signaling device needs dissipation means with a substantial mass. In order to overcome this difficulty, it is known to use a fan or a similar unit which induces forced passage of the flow of air along the fins of the cooling unit which equips the optical modules. The use of such a flow of air with forced passage makes it possible to limit the heat-exchange surface, and therefore the size of the cooling unit, and consequently makes it possible to limit the overall size of the optical module or group of optical modules. By way of example, reference can be made to document WO2005116520 which describes arrangements of this type. Also by way of example, it is known to use a heat pipe which can convey heat by conduction from the material which constitutes it, and/or which is placed in a hermetically sealed pipe which can convey a heat-exchanging fluid which it contains. The heat-exchanging fluid is, for example, water or any other fluid which can be used for heat exchange. The pipe is closed, for example, by closure of its ends, or by closure of the pipe in a loop on itself. One end of the heat pipe is in contact with the cooling unit which equips the optical module(s) in order to collect by conduction the heat which is produced by the source(s) of light, whereas its other end is in contact with a cooling unit which is placed on the exterior of the housing, in order to discharge the heat which is conveyed by the heat pipe. Reference can be made, for example, to documents EP1881262 or US2008/0025038 which describe arrangements of this type.

There is, therefore, a need to provide an improved device for cooling an optical module for a motor vehicle.

SUMMARY OF THE INVENTION

The object of the present invention is to propose a device for cooling one or a plurality of optical modules for a motor vehicle headlight, in order to optimize the cooling of the optical modules of a lighting and/or signaling device.

The device according to the present invention is a lighting and/or signaling device comprising at least one optical module which is equipped with a cooling unit provided with a heat-exchange surface. It also comprises a cooling device comprising at least one heat conductor, a first end of which constitutes a surface which is cold in relation to the air which surrounds the optical module, the first end being placed spaced from the cooling unit, and being provided with a plurality of deflectors which channel a flow of cold air obtained from the first end towards the heat-exchange surface of the cooling unit, such as to permit exchange of heat between the flow of air and this heat-exchange surface. Preferably, the space between two adjacent deflectors constitutes a channel for guiding the flow of air, which is delimited by the two deflectors, and opens onto at least one passage which is delimited between two adjacent fins which the cooling unit comprises.

The proximal end of the heat conductor will be understood to mean an area of the latter which is situated in the vicinity of the optical module(s), and is opposite its other, distal end, spaced from the optical module(s). During operation of the headlight, and more particularly during the activation of the source(s) of light of the optical module(s), the proximal end of the heat conductor is a surface which is cold in relation to the air which surrounds the optical module, and conveys negative calories from its distal end to the vicinity of the cooling unit, from which its proximal end is placed at a close distance. The flow of air is naturally cooled at the level of the proximal end of the heat conductor by the negative calories which it conveys. The device thus permits an exchange of heat by convection between the heat-exchange surface of the cooling unit which equips the optical module, and the heat conductor.

The space between two adjacent deflectors, i.e., the channel for guiding the flow of cold air, makes it possible to improve the channeling of the flow of cold air in the direction of the cooling unit of the optical module. The channel for guiding the flow of cold air advantageously opens onto passages delimited between two adjacent fins which the cooling unit comprises. It will be appreciated that the fins are elements which delimit the global heat-exchange surface of the cooling unit. This makes it possible to assure the continuity of the channeling of the flow of air from the distal end of the heat conductor as far as between the fins of the cooling unit.

The distance which separates the deflectors and the heat-exchange surface of the cooling unit is by way of indication greater than 0 cm and less than 2 cm, and is preferably between 0 cm and 1 cm. Preferably, the channel for guiding the cold air opens at a distance from at least one passage of between 0 cm and 2 cm, and preferably between 0 cm and 10 cm. The deflectors are preferably placed as close as possible to the cooling unit, in order to prevent dispersion of the flow of cold air, and to assist guiding of the latter towards the heat-exchange surface of the cooling unit. However, if applicable, this proximity is limited to the required option of mobility of the optical module(s). It will be understood in this respect that the distance which separates the deflectors and the cooling unit is dependent on a compromise between angular clearance provided for the optical module for the purpose of its mobility in the housing, and an optimized path of the flow of cold air towards the heat-exchange surface of the cooling unit.

According to one embodiment, the deflectors are arranged with spaced superimposition. This makes it possible to introduce the cold air laterally.

The cooling device according to the present invention allows it to be used for any optical module or group of optical modules, the sources of light of which have an operating power which can emit a light beam with a moderate or strong intensity. Advantageously, this cooling device is applied to LEDs or light-emitting diodes, the heat generated by which must be discharged. This device is particularly advantageous for power LEDs which are used in optical modules which emit a lighting beam, for example, of the dipped and/or full-beam type, or in optical modules for emission of a daytime position light, also known as DRL (Day Running Light). Power LEDs are LEDs which generally have a flow of light of at least 30 lumens, and emit heat which is greater than that of LEDs with a lesser flow of light.

Thus, the lighting and/or signaling device according to the present invention comprises at least one light-emitting diode or LED which is in thermal contact with the cooling device. Preferably, the light-emitting diode is a power LED.

In addition, the cooling device which is used in the headlight according to the present invention has a size and arrangement which do not impede easy installation of the optical module in the interior of the housing, in particular on the basis of obtaining a size and weight of the cooling device and/or of the optical modules which are as small as possible.

The cooling unit is preferably a heat dissipater with fins, the heat-exchange surface of which is formed by the surface of the fins which are in contact with the flow of air, in order finally to obtain the cooling of the optical module(s).

In order to increase the phenomenon of radiation, and therefore the exchange of heat, the cooling unit and/or the deflector(s) can, for example, be black. On an aluminum part, for example, this color can be obtained by anodization.

The flow of air is naturally generated by the rising movement of the air which is heated at the level of the heat-exchange surface of the cooling unit, the temperature of this heat-exchange surface being greater than that of the surrounding air. For example, the air is heated between the fins of the cooling unit when the latter is provided with these. This rising movement aspirates the air which is present at the level of the deflector and/or the heat conductor, where it has been cooled. This aspirated air therefore has a temperature which is colder than the air which surrounds the optical module, and thus makes it possible to cool efficiently the cooling unit which equips this optical module.

Since the heat conductor is placed at a distance from the optical module, i.e., without mechanical contact with the optical module, the latter can easily be fitted such as to be mobile in the interior of a housing which the headlight comprises, without the means which are implemented for its cooling impeding this mobility. The size of the heat-exchange surface, and therefore the dimensions and weight of the cooling unit, can be restricted by means of the contribution of the flow of cold air, which facilitates further the arrangement, fitting and installation of the parts, in particular of the optical module, in the interior of the housing. The cooling device can be used for cooling of one or a plurality of optical modules, the source(s) of light of which can equally well be low-power, such as the LEDs which are used in signaling devices of the town lamp type, indicators for change of direction, rear lights, or lights with moderate or strong power, such as the power LEDs which are used in a DRL or in lighting devices, of the full-beam, dipped or fog-light type, or according to the light beam to be emitted by the headlight. The heat conductor can be cooled at its distal end by any additional cooling means, which can be installed on the exterior of the housing, in order to avoid encumbrance of the interior volume of the latter. The additional cooling means can be of any type, and can be determined according to the power of the source of light to be cooled, for example, by using the air on the exterior of the vehicle in isolation or in combination in order to avoid the use of an energy-consuming unit, a unit for generation of a flow of forced air, such as a fan or a similar unit, a source of cold such as a duct which conveys a fluid obtained from a cooling circuit, and in particular a cooling circuit of a ventilation, heating and/or air-conditioning installation with which the vehicle is equipped. Whether or not various additional cooling means are used can be decided independently from the arrangement and structural organization of the main components of the cooling device, i.e., the means for cooling and channeling of the flow of air, which are constituted mainly by a heat conductor which is equipped with a deflector or deflectors. The modularity of the cooling device on the basis of selective implementation of the additional cooling means makes it possible to ensure that the cooling device is of a standard nature which is favorable to the viability of its use, and consequently of its sale.

The heat-exchange surface of the cooling unit is more specifically oriented according to the general axis of gravity. The heat-exchange surface of the cooling unit is thus oriented such that it is naturally swept by the ascending flow of the air which is being heated. This orientation is taken into consideration when the general axis of emergence of the light outside the optical module is oriented approximately perpendicularly to the general axis of gravity. This general orientation of emergence of the light corresponds approximately to the orientation which the lighting and/or signaling device has once it is fitted on the vehicle for which it is destined.

For example, the cooling unit is in the form of a heat dissipater with fins or a similar unit. The general plane of the fins is oriented according to the general axis of gravity. The heat-exchange surface is formed by the surfaces of the fins which are in contact with the flow of air, in order finally to obtain the cooling of the optical module(s).

Preferably, the heat-exchange surface defines a general plane of heat exchange which is preferably oriented at right-angles to the general plane of the deflector. More generally, and for preferential values in relation to the heat-exchange performance obtained between the flow of air obtained from the proximal end of the heat conductor and the cooling unit, for each deflector of the plurality of deflectors, a general plane of the deflector opposite the cooling unit is defined. This general plane of the deflector is oriented such as to form an angle of between 80° and 130° with the general axis of gravity, this angle being measured starting from the central axis of gravity, above the corresponding deflector, when the general axis of emergence of the light from the optical module is oriented substantially at right-angles to the general axis of gravity. Preferably, this angle is between 90° and 120°, and more preferably between 90° and 100°.

The arrangement of the cooling device, and in particular the specific orientation of the heat-exchange surface and the deflectors, induces sweeping of the latter by the flow of air on the basis of successive descending natural movements of the flow of cold air obtained from the heat conductor, then ascending movements of this flow of cold air heated progressively by the heat-exchange surface. The exploitation of the flow of air cooled by the heat conductor is optimized by dual sweeping of this flow of air of the heat-exchange surface of the cooling unit.

According to a variant embodiment, the general plane of each deflector of the plurality of deflectors and opposite the cooling unit is oriented such as to form with the general axis of gravity an angle of 40° at the most, this angle being measured starting from the central axis of gravity, and above the corresponding deflector, when the general axis of emergence of the light from the optical module is oriented substantially at right-angles to the general axis of gravity, with the guide channel opening below the passage. Preferably, this angle is 20° at the most, and more preferably approximately 0°, i.e., parallel to the direction of gravity. When the general axis of emergence of the light from the optical module is oriented substantially at right-angles to the general axis of gravity, there are therefore ideally deflectors which are oriented vertically, placed below the heat dissipater. In this case the arrangement of the cooling device, and in particular the specific orientation of the heat-exchange surface and of the deflectors, also induces sweeping of the heat-exchange surface by the flow of air, on the basis of natural movements. In this embodiment, by heating the air, the radiator creates a natural ascending movement of the air. This movement induces a phenomenon of aspiration of the air which is present in the guide channels, where the air has already lost a certain number of calories. The cooled air will thus sweep the surface of the fins whilst rising in the passages, and thus permit improved dissipation of heat.

According to the embodiment referred to in the preceding paragraph, a plate is placed at the rear of the heat dissipater, i.e., on the side opposite that which supports the source of light. This plate makes it possible to channel the flow of air better towards the top of the heat dissipater. Each passage thus comprises an intake for the flow of cold air at the bottom of the heat dissipater, and an outlet for the flow of hot air at the top of the heat dissipater.

Preferably, the heat conductor is a heat pipe. The lighting and/or signaling device according to the invention can comprise a plurality of heat conductors, and thus in particular a plurality of heat pipes. Similarly, a cooling device can comprise a plurality of heat conductors, for example, a plurality of heat pipes associated with one or a plurality of deflectors, which channel the air towards the heat-exchange surface in order to cool it. The heat pipe(s) consist(s) of a hermetically sealed duct, which, for example, is made of copper, and contains a heat-exchanging fluid. The heat-exchanging fluid is, for example, water, or any other fluid which can be used for exchange of heat. The fluid goes from the liquid to the gaseous state at a first end of the heat pipe. The fluid in gaseous form then circulates as far as a second end of the heat pipe, where it condenses. The fluid in liquid form then returns from the second end to the first end. Thus, the heat pipe can convey calories from its first end to its second end, and negative calories from its second end to its first end. The closure of the pipe is obtained, for example, by closing its ends, or by closure of the pipe in a loop on itself. The first end of the heat pipe is situated in the vicinity of the optical module(s), and thus corresponds to a proximal end opposite the second, distal end which is spaced from the optical module(s). The proximal end of the heat pipe is formed in particular by an area of the latter which is disposed in the interior of a housing of the headlight which accommodates the optical module(s), whereas the distal end of the heat pipe is an area of the latter which is placed where the air has a lower temperature than the air at the level of the optical module, preferably on the exterior of the housing, whilst advantageously being in thermal relation with the additional cooling means, which themselves are disposed on the exterior of the housing, in order to avoid encumbering the interior space of the latter. It is also possible to position the distal end in the interior of the housing, for example, in the vicinity of the glass which closes the housing. This then makes it possible to cool the distal end, and also to limit the phenomena of condensation or frost on the glass, by providing heat at the level of the latter.

Preferably, the deflectors have a high level of thermal conductivity, i.e., greater than 10 W/m/° C. (10 Watts per meter per degree Celsius). The deflectors thus also have a function of dissipation of the negative calories obtained from the proximal end of the heat conductor, therefore making it possible to cool the flow of cold air more efficiently.

The deflectors are each advantageously formed by a plate through which the first end of the heat pipe passes. As seen in the preceding paragraph, this metal plate has in particular characteristics of thermal conductivity which are high, i.e., greater than 10 W/m//° C., whilst being formed, for example, from a sheet of metal. The physical contact between the metal plate and the heat pipe which passes through it makes it possible not only to obtain an easy positioning of the metal plate axially on the heat pipe, but also to assist the dissipation of the negative calories obtained from the heat pipe.

A single heat pipe can be dedicated to the cooling of a plurality of optical modules. The optical modules are supported equally well by a cooling unit which is common to them, or by a cooling unit which is specially dedicated to them. In this last case, preferably, a plurality of deflectors is placed opposite each of the cooling units of the optical modules.

According to the necessary quantity of negative calories to be conveyed to the heat-exchange surface of the cooling unit, the distal end of the heat conductor is in thermal relationship with additional cooling means and/or with a heat-exchange unit, such as fins or similar heat-exchange units. The supply of negative calories by the heat conductor to its proximal end can be optimized. Putting the distal end of the heat conductor into thermal relationship with the additional cooling means can be obtained equally well by conduction or by convection, depending on the nature of the additional cooling means used. The heat-exchange units can be dedicated to one or a plurality of heat conductors which the cooling device comprises. Preferably, the additional cooling means and/or the heat-exchange unit are placed on the exterior of the housing.

These and other objects and advantages of the invention will be apparent from the following description, the accompanying drawings and the appended claims.

The heat pipe is preferably positioned and maintained in the interior of the housing by means of securing units which are at least engaged on the housing, with the exclusion of the optical module and/or the cooling unit which supports it. It will be understood that by means of this exclusion, the heat pipe is free from means of mechanical securing to the cooling unit and/or to the optical module(s), because of its physical positioning spaced from the latter. Spaced positioning of this type without a mechanical connection between the optical module and the heat pipe provided with the deflector(s) permits mobility of the optical module in the interior of the housing, whilst allowing the module to be cooled by means of the heat pipe. The heat pipe can be engaged on the housing in order to be maintained in the interior of the latter, either directly or by means of units which are integral with the housing, and/or it can be engaged on any other fixed element of the headlight, or even of a structural element of the vehicle which contains the headlight, with the exclusion of the optical module and/or the cooling unit which is secured to this optical module.

BRIEF DESCRIPTION OF THE ACCOMPANYING DRAWINGS

The present invention will be described in relation with non-limiting embodiments which are illustrated in the figures of the attached drawings, in which.

DETAILED DESCRIPTION OF THE PREFERRED EMBODIMENTS

Figure 1:
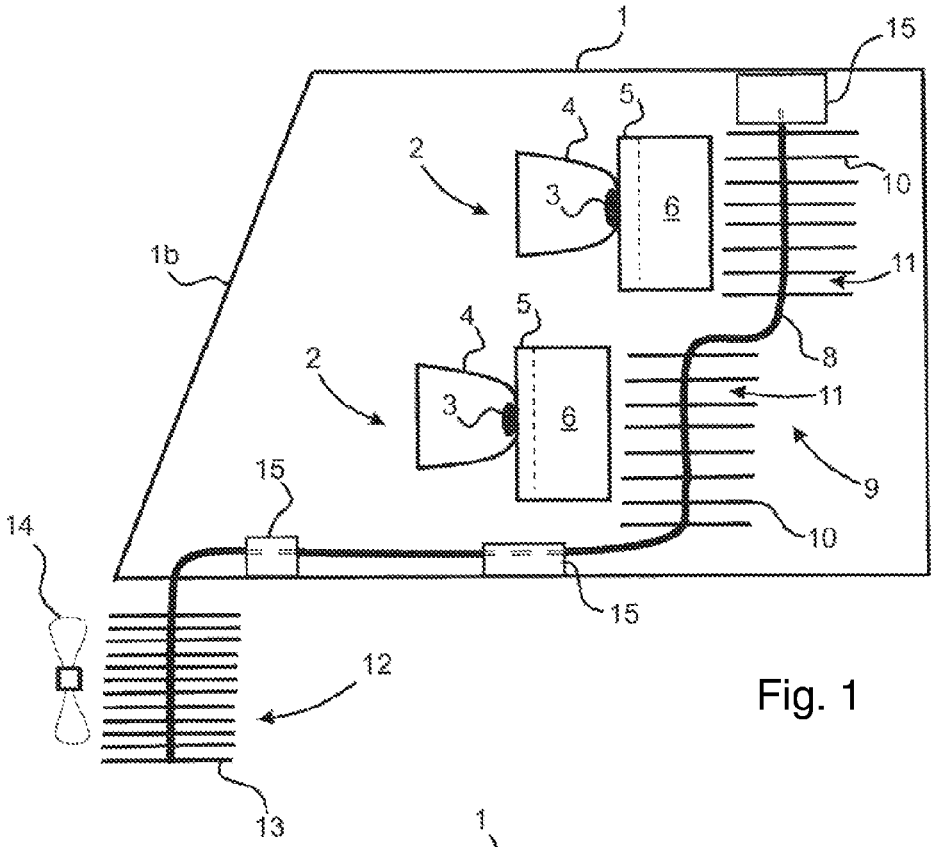
FIG. 1 is a diagram illustrating a longitudinal cross-section of a headlight equipped with optical modules and a cooling device according to an embodiment of the present invention.
Figure 2:
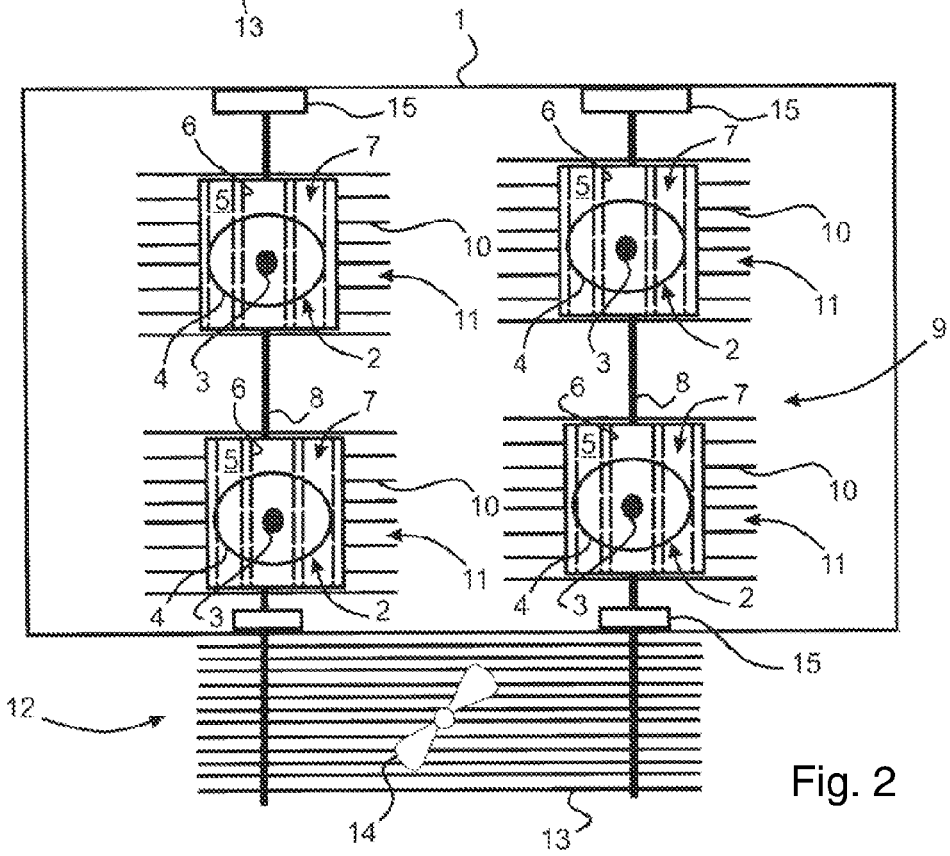
FIG. 2 is a diagram illustrating a view from the front of a headlight as represented in FIG. 1.
Figure 5:
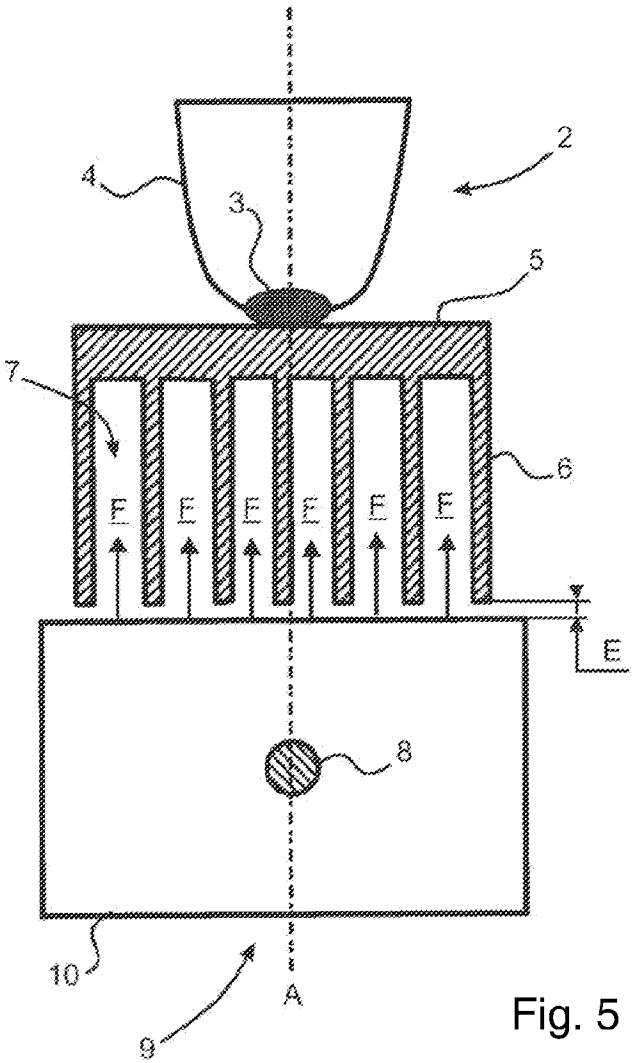
FIG. 5 is a diagram illustrating a cross-section of a cooling device and an optical module represented in FIGS. 1 to 3, according to a horizontal plane which passes via the general axis of emergence of the light emitted by the optical module.

In FIGS. 1 and 2, a headlight for a motor vehicle comprises a housing 1 which is closed by transparent closure glass 1*b*. The housing 1 accommodates a plurality of optical modules 2 for emission of at least one global light beam. These optical modules 2 associate a source of light 3 which is constituted by an LED and an optical system which can modify at least one of the parameters of the light which is generated by the source of light 3, such as its mean reflection and/or its direction. In the example represented, the optical system comprises a reflector 4, which concentrates the light emitted by the source of light 3 in the direction of the transparent closure glass 1*b*, i.e., towards the left in the diagram in FIG. 1. The optical modules 2 are supported by cooling units 5, which are designed to dissipate the heat which is generated by the source of light 3 in operation. The cooling units 5 consist of a heat dissipater with fins, the fins 6 constituting a global surface of heat exchange with the ambient air in order to obtain the cooling of the optical module 2 which is allocated to them. In the embodiment illustrated, the optical modules 2 are supported by a cooling unit 5 which is dedicated to them. However, the optical modules 2 can also be supported by a cooling unit 5 which is common to them.

The fins 6 are oriented on their general plane vertically relative to the general axis of gravity, such that the discharge of the heat is derived from a natural ascending movement of the air as it heats up whilst circulating along the passages or channels 7 which extend between the fins 6 taken in pairs which the cooling unit 5 comprises. In FIG. 2, each cooling unit 5 comprises three passages 7, but this number is non-limiting.

In order to assist the cooling of the optical module 2, the cooling unit 5 is associated with means which channel and cool a flow of air, which comprise a plurality of heat pipes 8 which are disposed at the rear of, and spaced from the cooling units 5. It will be appreciated that the rear position should be considered in relation to the emergence of the light from the optical module 2, towards the front of the latter.

Figure 3:
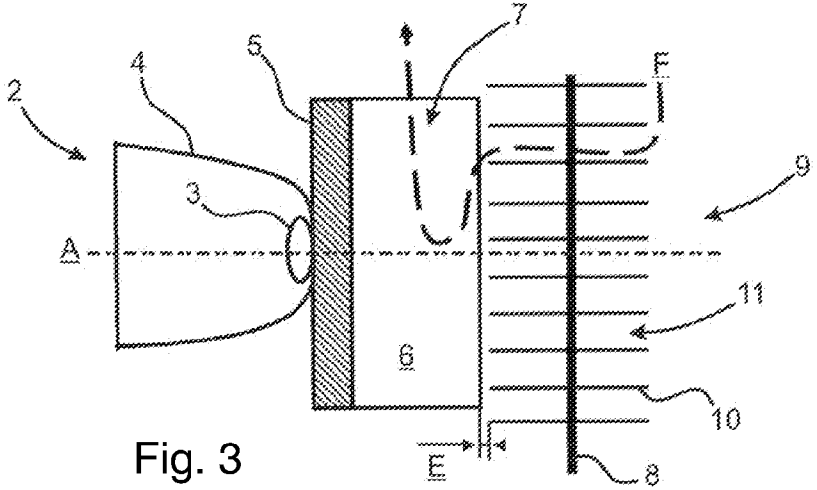
FIG. 3 is a diagram illustrating a cross-section of a cooling device and a corresponding optical module, represented in FIG. 1 and FIG. 2, according to a vertical plane which passes via the general axis of emergence of the light emitted by the optical module.
Figure 4:
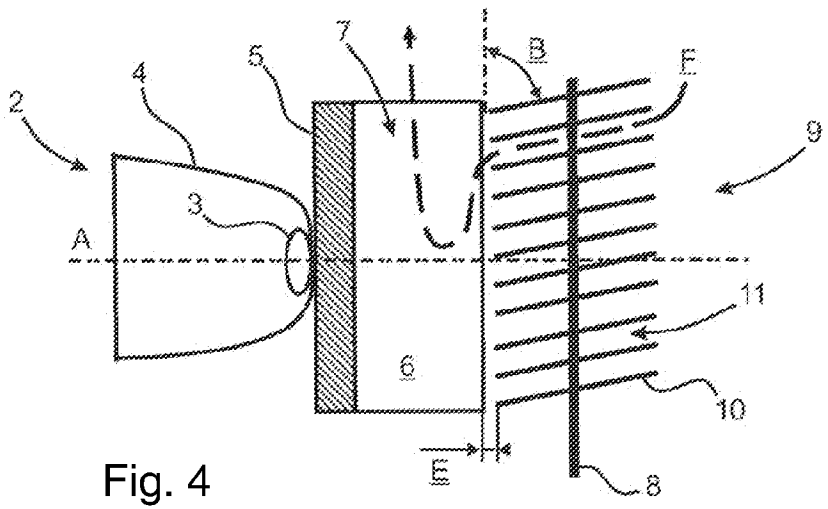
FIG. 4 is a diagram illustrating a cross-section of a cooling device and an optical module of a variant embodiment, according to a vertical plane which passes via the general axis of emergence of the light emitted by the optical module.

With reference also to FIGS. 3 and 4, the proximal end 9 of the heat pipes 8 is provided with a plurality of deflectors or metal plates 10, which provide between them in pairs channels 11 for guiding the flow of cold air F. The proximal end 9 supplies the negative calories to the deflectors 10 which cool the air which circulates in the interior of these channels 11, before this air enters into the interior of the channels 7 formed between the fins 6 of the corresponding cooling unit 5. The deflectors 10 are placed spaced from the cooling unit 5, with spacing E which is greater than 0 cm and preferably less than 2 cm. The general plane of the deflectors 10 is oriented transversely to the orientation of the general plane of the fins 6. In FIG. 3, the general plane of the deflectors 10 is oriented at right-angles to the general plane of the fins 6. In FIG. 4, the deflectors 10 and the fins 6 are disposed on respective planes which are convergent relative to one another, according to a gradient with inclination B of between 60° and 90° in one illustrative embodiment or between 80° and 130° in another illustrative embodiment. This inclination also corresponds to an orientation of the general plane of the deflector 10 opposite the cooling unit 5, which forms together with the general axis of gravity an angle of between 120° and 90° respectively, this angle being measured starting from the central axis of gravity, above the deflector 10, when the general axis of emergence of the light A from the optical module 2 is oriented substantially at right-angles to the general axis of gravity shown as a broken line in FIG. 4. This inclination value is provided by way of indication, and in a non-restrictive manner. In the embodiment illustrated, the deflectors 10 are globally flat. However, it can be envisaged to provide them with areas of inflection according to the required form of the guide channels, which determine the dynamics sought for guiding the flow of cold air F which is conveyed towards the cooling unit 5 via the guide channels 11 delimited between two deflectors 10 which are superimposed, i.e., opposite.

In the example illustrated, the deflectors 10 which are allocated to the cooling of an optical module 2 are formed by metal plates which are placed superimposed and spaced along the corresponding heat pipe 8. The metal plates 10 are joined to the heat pipe 8, for example, by means of the heat pipe 8 which is allocated to the metal plates 10 passing through the latter, preferably associated with force fitting in this passage and/or sealing of the metal plates 10 on the heat pipe 8. The metal plates 10 are formed by metal sheets which assist the exchange of heat between the air which surrounds the proximal end 9 and the heat pipe 8. The deflectors 10 fulfill two cumulative functions, i.e., one of guiding the flow of air F at the level of the heat pipes 8 and towards the corresponding cooling units, and the other of acting as units for exchange of heat between these deflectors and the air which surrounds the proximal ends 9 of the heat pipes 8, and circulates between the latter. The channels 11 for guiding the flow of cold air F open onto the fins 6, and more particularly onto the passages 7 which are provided between them. The air is thus cooled in contact with the proximal end 9 and its deflectors 10. The flow of cold air F is conveyed by the guide channels 11 which are provided between two adjacent superimposed deflectors 10, whilst being aspirated by the passages 7 which are provided between two adjacent fins 6. The flow of air F thus circulates between the deflectors, where it is cooled, and when discharged from the guide channels 11 into the passages 7 of the cooling unit, the cold air is denser, and descends whilst being heated along the fins 6. Once the air has been reheated it is lighter, and rises in order to be discharged from the top of the channels 7 of the cooling unit 5.

In FIGS. 1 and 2, the distal end 12 of the heat pipes 8 emerges from the housing 1 in order to be placed on the exterior of the latter. The distal end 12 of the heat pipes 8 is provided with heat-exchange units or elements 13 which are arranged in the form of fins or similar elements. In these two figures, additional cooling means 14, such as a fan, are disposed on the exterior of the housing 1, in order to induce cooling of the heat-exchange units 13, and consequently the heat pipes 8. Putting into place additional cooling means 14 on the exterior of the housing 1 facilitates their installation in the vehicle, and makes it possible to avoid encumbering the interior space of the housing 1. The negative calories which are conveyed to the heat pipes 8 by the heat-exchange units 13 are conducted to their proximal end 9 in order to cool the flow of cold air F which is designed to cool the optical modules 2, and is channeled by the deflectors 10. In the embodiment illustrated, these heat-exchange elements 13 are common to all of the heat pipes 8 of the headlight. However, depending on the arrangement of the headlight's environment in the vehicle, it can be envisaged to allocate a group of heat-exchange elements 13, or cold generator means 14, to each of the heat pipes 8 which the cooling device comprises.

The heat pipes 8 are maintained in position in the interior of the housing 1 by securing units 15 which are engaged on the latter. The securing of the heat pipes 8 on separate elements of the optical modules 2 makes it possible to position them easily relative to the latter, whilst maintaining the required distance of separation between the deflectors 10 and the cooling units 5. The lack of a mechanical connection between the heat pipes 8 and the optical modules 2 makes it possible to fit the latter easily with mobility on the housing 1.

It should be noted that in the non-limiting embodiment illustrated, certain modules are connected by a single heat pipe 8. Other configurations are however possible. It would also be possible to have one heat pipe per optical module.

Figure 6:
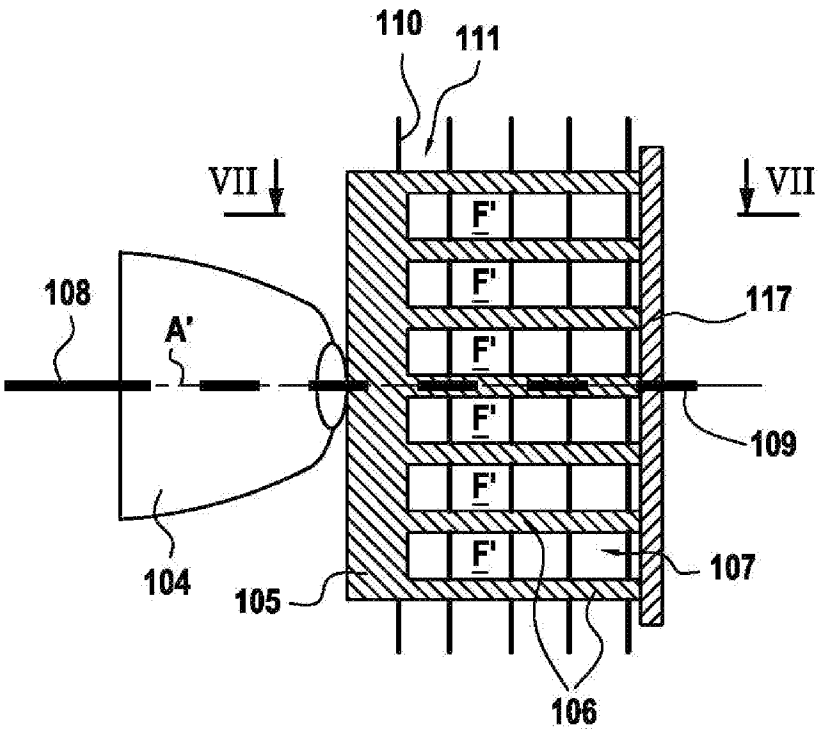
FIG. 6 is a diagram illustrating a view in cross-section of a cooling device and an optical module of another variant embodiment, according to a horizontal plane which passes via the general axis of emergence of the light emitted by the optical module.
Figure 7:
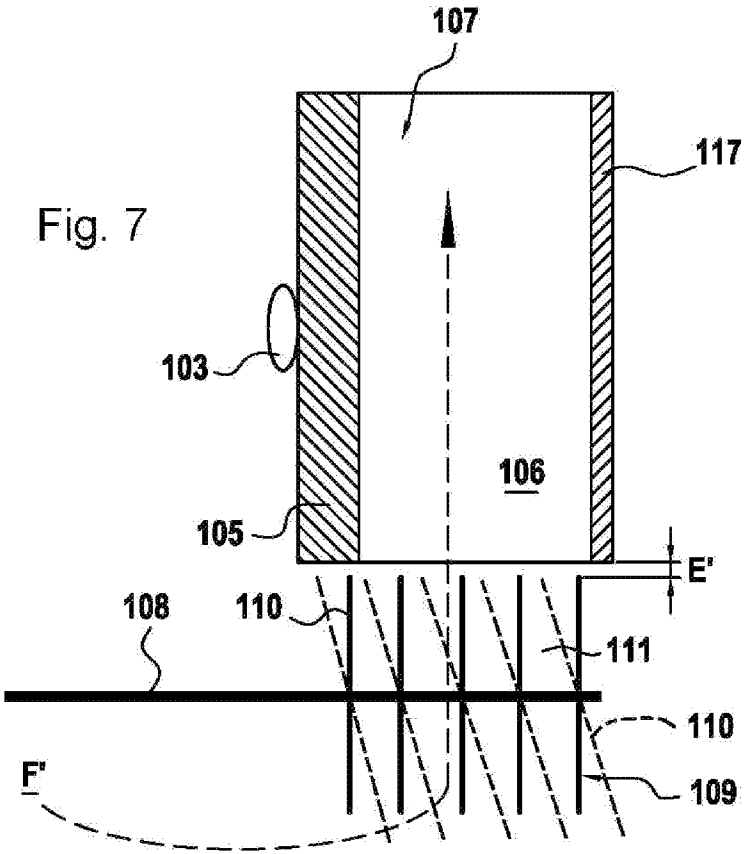
FIG. 7 is a diagram illustrating a cross-section according to VII-VII in FIG. 6.

As a variant embodiment of the optical modules illustrated in FIGS. 1 to 5, it is possible to place the heat conductor beneath the heat dissipater. This variant embodiment is illustrated in FIGS. 6 and 7, marked as FIG. 6 and FIG. 7. The heat conductor 108, which in this case is a heat pipe, comprises deflectors 110 opposite the cooling unit or heat dissipator 105, the general plane of these deflectors 110 being oriented such as to form together with the general axis of gravity an angle of 40° (shown in phantom lines in FIG. 7) at the most, and 0° (shown in solid lines in FIG. 7) in the example illustrated, this angle being measured starting from the central axis of gravity, and above the corresponding deflector 110, when the general axis A' of emergence of the light from the optical module 102 is oriented substantially at right-angles to the general axis of gravity. The guide channels 111 which are formed by the spaces between two adjacent deflectors open below the passages 107 which are formed between two adjacent fins 106 of the heat dissipater 105. Preferably, the deflectors 110 are placed spaced from the cooling unit 5, with spacing E' which is greater than 0 cm, preferably less than 2 cm, and more preferably less than 1 cm.

In this example, the deflectors 110 are oriented vertically, and are placed below the heat dissipater 106. The arrangement of the cooling device, and in particular the specific orientation of the fins 106 and the deflectors 110, induces sweeping of the fins 106 by the flow of air F'. As can be seen in FIG. 7, where the flow of air is represented by the arrow and broken line, the air is progressively heated by the heat-exchange surface corresponding to the surface of these fins 106, and is driven by ascending movement. This results in a phenomenon of aspiration from the lower part of the heat dissipater 105, of the air which is present in the guide channels 111, where the air has already lost a certain number of calories. The cooled air will thus sweep the surface of the fins 106 whilst rising in the passages 107, and thus permit improved dissipation of heat.

A plate 117 is placed at the rear of the heat dissipater 106, i.e., on the side opposite that which supports the source of light 103. This plate 117 makes it possible to channel the flow of air F' better towards the top of the heat dissipater 105. Each passage 107 between two fins 106 thus comprises an intake for the flow of cold air at the bottom of the heat dissipater 105, and an outlet for hot air at the top of the heat dissipater 105. It should be noted that, for the sake of clarity, the reflector 104 is not shown in FIG. 7, but only in FIG. 6.

The distal end 109 is placed below the heat dissipater 105, and the arrangement of the distal end of the heat conductor 108 is disposed as previously described, and in particular as for the example illustrated in FIGS. 1 to 5. Furthermore, this variant can be used for cooling a plurality of optical modules as illustrated in FIGS. 1 and 2, with the difference that the distal ends are situated below the optical modules, in accordance with the variant described in FIGS. 6 and 7.

In addition, the number of fins of the cooling unit of the optical module, or the number of deflectors, is not limited. Also, the distance between the fins or the deflectors can be variable.

Also, when there is a plurality of deflectors on the heat pipes, the latter can consist of the turns of a spiral metal plate which is wound around the heat pipe. It is therefore possible to constitute the assembly of the deflectors by means of a sheet metal plate which is cut out in a spiral, then drawn in order to be formed around the heat pipe.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A lighting and/or signaling device comprising:

at least one optical module which is equipped with a cooling unit provided with a heat-exchange surface having a plurality of fins; and a cooling device comprising at least one heat conductor, a first end having a surface which is cold relative to the air which surrounds said at least one optical module, said first end being placed spaced from said cooling unit and being provided with a plurality of deflectors which channel a flow of cold air obtained from said first end towards said heat-exchange surface of said cooling unit, such as to permit exchange of heat between said flow of cold air and said heat-exchange surface, a space between two adjacent deflectors of said plurality of deflectors having a guide channel for said flow of cold air which is delimited by the two adjacent deflectors and opens onto at least one passage which is delimited between two adjacent fins of said plurality of fins of said cooling unit;

said at least one passage being oriented in a generally vertical plane relative to a general axis of gravity, such that a discharge of heat derives from naturally ascending movement of air as it heats up while circulating through said at least one passage, said two adjacent deflectors being oriented generally transversely to an orientation of a general plane in which said at least one passage lies so that said two adjacent deflectors may guide air through said guide channel and onto said two adjacent fins.

2. The lighting and/or signaling device according to claim 1, wherein said at least one optical module comprises at least one light-emitting diode which is in thermal contact with said cooling unit.

3. The lighting and/or signaling device according to claim 2, wherein said at least one light-emitting diode is a power LED.

4. The lighting and/or signaling device according to claim 1, wherein said heat-exchange surface of said cooling unit is oriented according to said general axis of gravity, when a general axis of emergence of said light outside said at least one optical module is oriented substantially at right-angles to said general axis of gravity.

5. The lighting and/or signaling device according to claim 1, wherein said deflectors are in spaced superimposition when viewed along an axis of said at least one optical module.

6. The lighting and/or signaling device according to claim 1, wherein a general plane of each deflector of said plurality of deflectors, opposite said cooling unit is oriented such as to form an angle of between 80° and 130° with said axis of gravity, said angle being measured starting from a central axis of gravity, above the corresponding deflector, when a general axis of emergence of light from said at least one optical module is oriented substantially at right-angles to said general axis of gravity.

7. The lighting or signaling device according to claim 1, wherein a general plane of each deflector of said plurality of deflectors and opposite said cooling unit is oriented such as to form with said general axis of gravity an angle of 40° at the most, said angle being measured starting from a central axis of gravity, and above the corresponding deflector, when a general axis of emergence of the light from said at least one optical module is oriented substantially at right-angles to said general axis of gravity, with said guide channel opening below said at least one passage.

8. The lighting and/or signaling device according to claim 1, wherein said at least one heat conductor is a heat pipe.

9. The lighting and/or signaling device according to claim 8, wherein said plurality of deflectors are each advantageously formed by a plate through which said first end of said heat pipe passes.

10. The lighting and/or signaling device according to claim 1, wherein said plurality of deflectors each have thermal conductivity which is greater than 10 W/m/° C.

11. The lighting and/or signaling device according to claim 1, wherein a distance (E, E') which separates said plurality of deflectors and said heat-exchange surface of said cooling unit is greater than 0 cm and less than 2 cm.

12. The lighting and/or signaling device according to claim 1, wherein said at least one heat conductor is a heat pipe which is dedicated to cooling a plurality of optical modules.

13. The lighting and/or signaling device according to claim 1, wherein said first end is a proximal end, said at least one heat conductor also comprising a distal end which is in thermal relationship with additional cooling means and/or with a heat-exchange unit.

14. The lighting and/or signaling device according to claim 13, wherein said additional cooling means and/or said heat-exchange units are placed on the exterior of a housing.

15. The lighting and/or signaling device according to claim 1, wherein said at least one heat conductor is a heat pipe, said heat pipe being positioned and maintained in the interior of a housing by means of securing units which are at least engaged on said housing, with the exclusion of said at least one optical module and/or said cooling unit.

16. A lighting and/or signaling device comprising:

at least one optical module engaged with a cooling unit having a plurality of fins that define a plurality of air passageways for heat exchange;

at least one heat conductor, a first end of which constitutes a surface which is cold relative to the air which surrounds said at least one optical module, said first end being placed spaced from said cooling unit;

said at least one heat conductor comprising a plurality of deflectors which channel a flow of cold air obtained from said first end, towards said plurality of fins of said cooling unit to permit exchange of heat between said flow of cold air past said plurality of deflectors and toward said plurality of fins, a space between said plurality of deflectors defining a guide channel for the flow of cold air which is delimited by said plurality of deflectors and opens into at least one of said plurality of air passageways;

said plurality of air passageways being oriented in a generally vertical plane relative to a general axis of gravity, such that a discharge of heat derives from naturally ascending movement of air as it heats up while circulating through said plurality of air passageways, said plurality of deflectors being oriented generally transversely to an orientation of a general plane in which said at least one passage lies so that said plurality of deflectors may guide air through said guide channel and onto said plurality of fins.

17. The lighting and/or signaling device according to claim 16, wherein said at least one optical module comprises at least one light-emitting diode which is in thermal contact with said cooling unit.

18. The lighting and/or signaling device according to claim 17, wherein said at least one light-emitting diode is a power LED.

19. The lighting and/or signaling device according to claim 16, wherein a heat-exchange surface of said cooling unit is oriented according to a general axis of gravity, when a general axis of emergence of said light outside said at least one optical module is oriented substantially at right-angles to said general axis of gravity.

20. The lighting and/or signaling device according to claim 16, wherein said at least one heat conductor is a heat pipe.

* * * * *

UNITED STATES PATENT AND TRADEMARK OFFICE

CERTIFICATE OF CORRECTION

PATENT NO. : 8,297,805 B2
APPLICATION NO. : 12/640245
DATED : October 30, 2012
INVENTOR(S) : Roucoules et al.

It is certified that error appears in the above-identified patent and that said Letters Patent is hereby corrected as shown below:

In the Claims

In column 12, line 21, claim 6 after "said", please insert --general--.

Signed and Sealed this
Ninth Day of September, 2014

Michelle K. Lee

Michelle K. Lee
*Deputy Director of the United States Patent and Trademark Office*